US012378712B2

(12) United States Patent
Kim et al.

(10) Patent No.: US 12,378,712 B2
(45) **Date of Patent: *Aug. 5, 2025**

(54) APPARATUS FOR TREATING LAUNDRY

(71) Applicant: LG Electronics Inc., Seoul (KR)

(72) Inventors: Younghun Kim, Seoul (KR); Hyunsang Cho, Seoul (KR); Uikun Hwang, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 18/652,363

(22) Filed: May 1, 2024

(65) Prior Publication Data

US 2024/0271350 A1 Aug. 15, 2024

Related U.S. Application Data

(63) Continuation of application No. 17/587,496, filed on Jan. 28, 2022, now Pat. No. 12,000,075.

(30) Foreign Application Priority Data

Jan. 29, 2021 (KR) ..... 10-2021-0013487

(51) Int. Cl.
*D06F 37/22* (2006.01)
*D06F 37/04* (2006.01)
(Continued)

(52) U.S. Cl.
CPC ..... *D06F 37/225* (2013.01); *D06F 37/04* (2013.01); *D06F 37/265* (2013.01); *D06F 37/30* (2013.01)

(58) Field of Classification Search
CPC ..... D06F 37/04; D06F 37/225; D06F 37/265; D06F 37/30
See application file for complete search history.

(56) References Cited

U.S. PATENT DOCUMENTS

2002/0029648 A1 3/2002 Noguchi et al.
2006/0086863 A1 4/2006 Couchey et al.
(Continued)

FOREIGN PATENT DOCUMENTS

CN 103485126 1/2014
CN 107938253 4/2018
(Continued)

OTHER PUBLICATIONS

Extended European Search Report in European Appln. No. 22153495.1, dated Jun. 23, 2022, 9 pages.
(Continued)

*Primary Examiner* — Joseph L. Perrin
(74) *Attorney, Agent, or Firm* — Fish & Richardson P.C.

(57) ABSTRACT

An apparatus for treating laundry includes a tub, a drum, a motor configured to rotate the drum, a rotation shaft coupled to the motor, a first body including a first body hub located at a rotational center of the drum and fixed to the drum and a first body arm extended from the first body hub toward an edge of the drum, a second body including a second body hub located in the tub and fixed to the rotation shaft and a second body arm extended from the second body hub toward the first body arm, a connecting part connecting the first body to the second body and defining a space between the first body and the second body, and a reinforcement rib extended from the connecting part along the first body arm to connect the connecting part to the first body arm or the second body arm.

17 Claims, 8 Drawing Sheets

(51) Int. Cl.
*D06F 37/26* (2006.01)
*D06F 37/30* (2020.01)

(56) References Cited

U.S. PATENT DOCUMENTS

| | | | |
|---|---|---|---|
| 2013/0327099 | A1 | 12/2013 | Bae et al. |
| 2017/0274852 | A1 | 9/2017 | Jordan |
| 2019/0055688 | A1 | 2/2019 | Lee et al. |
| 2020/0010997 | A1 | 1/2020 | Kwon |

FOREIGN PATENT DOCUMENTS

| | | |
|---|---|---|
| CN | 108974125 | 12/2018 |
| CN | 110552141 | 12/2019 |
| CN | 110685118 | 1/2020 |
| CN | 111188155 | 5/2020 |
| DE | 102007048219 | 4/2009 |
| KR | 10-2009-0038185 | 4/2009 |
| WO | WO 2019/114306 | 6/2019 |

OTHER PUBLICATIONS

Notice of Allowance in Chinese Appln. No. 202210105033.7, mailed on Nov. 13, 2023, 14 pages (with English translation).
Office Action in Chinese Appln. No. 202210105033.7, mailed on May 7, 2023, 16 pages (with English translation).

APPARATUS FOR TREATING LAUNDRY

CROSS-REFERENCE TO RELATED APPLICATIONS

This application is a continuation of U.S. application Ser. No. 17/587,496, filed on Jan. 28, 2022, which claims the benefit of earlier filing date and right of priority to Korean Application No. 10-2021-0013487, filed on Jan. 29, 2021, the contents of which are hereby incorporated by reference herein in their entirety.

TECHNICAL FIELD

The present disclosure relates to a laundry treating apparatus, and more particularly, to a connector coupled to a drum and a rotation shaft to transmit the power of a motor to the drum.

BACKGROUND

A laundry treatment device conceptually refers to a device that includes a device for washing laundry, a device for drying laundry, and a device capable of performing both washing and drying of clothes. Conventional laundry treatment devices are categorized into a front loading type for putting laundry into a device through an entrance provided to a front side of the device and a top loading type for putting laundry into a device through an entrance provided to a topside of the device.

Irrespective of types of devices, a laundry treatment device of the related art includes a tub for storing water therein, a drum provided within the tub to store laundry therein, a motor generating a rotational force, and a rotation shaft connected to the drum to transmit the rotational force of the motor to the drum.

Such a washer of the related art is provided with a connector to connect a drum and a rotation shaft together. In order to transmit a rotational force of the rotation shaft from the center of the drum to a radial outside as well as to connect the rotation shaft to the center of the drum, a connector provided with an arm extended from the center of the drum in a radial direction and connected to the drum is used. Since the drum and the rotation shaft are connected using the connector as a medium, rotation of the rotation shaft can be transmitted to the drum more efficiently and the rotation shaft can be prevented from being broken or damaged.

Meanwhile, there is a related art washer provided with a shaft flange performing the same function of the above-described connector (Korean Patent Laid-Open Gazette No. 10-2009-0038185). A rotation shaft is coupled to the shaft flange and the shaft flange is coupled to a backside of a drum, whereby a rotational power of a motor is transmitted to the drum through the rotation shaft and the shaft flange. To reinforce the rigidity of the shaft flange, a main reinforcement rib is provided between a front wing part and a rear wing part, so that a cross-section of a wing part is provided in I-bema shape. However, there is a problem that various foreign substances such as dust and the like coming from laundry are stuck in a space formed by the main reinforcement rib, the front wing part and the rear wing part. In addition, as the main reinforcement rib is extended to an end portion of the wing part, it requires a considerable amount of material. Moreover, the weight of the main reinforcement rib increases, thereby consuming more power for rotation of the main reinforcement rib unnecessarily.

SUMMARY

Accordingly, embodiments of the present disclosure are directed to an apparatus for treating laundry that substantially obviates one or more problems due to limitations and disadvantages of the related art.

One technical task of the present disclosure is to provide a connector capable of minimizing the remaining foreign substance and a laundry treating apparatus provided with the connector.

Another technical task of the present disclosure is to provide a connector capable of transmitting a rotational power provided by a motor stably and a laundry treating apparatus provided with the connector.

Another technical task of the present disclosure is to provide a connector capable of minimizing weight of its own and a laundry treating apparatus provided with the connector.

Another technical task of the present disclosure is to provide a connector capable of maximizing durability as well as minimizing weight of its own and a laundry treating apparatus provided with the connector.

Further technical task of the present disclosure is to provide a connector capable of preventing a stress concentration site from being broken or damaged and a laundry treating apparatus provided with the connector.

Technical tasks obtainable from the present disclosure are non-limited by the above-mentioned technical tasks. And, other unmentioned technical tasks can be clearly understood from the following description by those having ordinary skill in the technical field to which the present disclosure pertains.

Additional advantages, objects, and features of the disclosure will be set forth in the disclosure herein as well as the accompanying drawings. Such aspects may also be appreciated by those skilled in the art based on the disclosure herein.

To solve the above tasks, an apparatus for treating laundry according to one embodiment of the present disclosure applies a diagonal rib structure to an edge generated from a portion contacting with an inner slide core to improve durability of a connector, thereby avoiding an undercut structure and supplementing a stress concentration site.

In addition, by applying a rib structure to a shaft-inserted portion side by side with an extended direction of an arm, materials consumed for manufacturing can be minimized and durability can be improved.

In addition, by putting more materials to a more durability required portion among various portions on a connector in a manner of further increasing thickness toward a center of the connector, durability can be improved as well as total weight is decreased.

To achieve these objects and other advantages and in accordance with the purpose of the disclosure, as embodied and broadly described herein, an apparatus for treating laundry according to one embodiment of the present disclosure may include a tub providing a space for storing water therein, a drum configured in a rotatable cylindrical shape within the tub to provide a space for storing the laundry therein, the drum including a first surface provided with a drum opening for inserting and withdrawing the laundry, a second surface provided to a location confronting the first surface, and a circumferential surface connecting the first surface and the second surface together, a motor providing power to rotate the drum, a rotation shaft coupled to the motor to transmit the power generated from the motor to the drum, a first body including a first body hub located at a rotation center of the drum by being fixed to the second surface and a first body arm extended from the first body hub toward an edge of the second surface, a second body including a second body hub located with the tub to have the rotation shaft fixed thereto and a second body arm extended from the second body hub to confront the first body arm, a connecting part connecting the first body and the second body together to maintain a state that the first body and the second body are spaced apart from each other, and a reinforcement rib extended from the connecting part in a length direction of the first body arm to connect the connecting part to the first body arm or the second body arm and to reinforce a coupling strength between the connecting part and the first body arm or the second body arm.

The connecting part may include a first connecting body inclined toward the rotation shaft from one of both confronting ends of the first body arm to connect the first body arm and the second body arm together, a second connecting body inclined toward the rotation shaft from the other one of the both confronting ends of the first body arm to connect the first body arm and the second body arm together, and a connecting point having the first connecting body and the second connecting body connected thereat.

The connecting point may be provided closer to the rotation shaft than the first or second connecting body located in a direction getting far away from the connecting point.

The reinforcement rib may be extended from the connecting point toward the rotation shaft to connect the connecting point and the first or second body arm together.

A plurality of the connecting parts may be provided in a manner of being spaced apart from each other along the length direction of the first body arm.

The reinforcement rib extended from one of the connecting parts and another one of the connecting parts may be spaced apart from each other along the length direction of the first body arm.

An extended length of the reinforcement rib extended from one connecting point may be set smaller than a spaced distance between the one connecting point and another adjacent connecting point.

The reinforcement rib may include a first reinforcement body connecting the connecting point and the first body arm together and a second reinforcement body connecting the connecting point and the second body arm together, and the first reinforcement body and the second reinforcement body may be spaced apart from each other along an axial direction of the rotation shaft A length of the first reinforcement body extended from the connecting point toward the rotation shaft may increase if getting farther away from the second reinforcement body, and a length of the second reinforcement body extended from the connecting point toward the rotation shaft may increase if getting farther away from the first reinforcement body.

The first body hub may include a first hub hole perforated along the rotation center, the second body hub may include a second hub hole perforated along the rotation center, and a circumferential rib connecting the first hub hole and the second hub hole together may be further included.

The apparatus may further include a support rib located between the first hub hole and the second hub hole to reinforce rigidity of the circumferential rib by being extended from an inner circumferential surface of the circumferential rib toward the rotation center.

The apparatus may further include a block rib extended from the inner circumferential surface of the circumferential rib to partition an inside of the circumferential rib and to form a space for receiving the rotation shaft inserted through the second hub hole, and the support rib may be extended from the first hub hole to the block rib along an axial direction of the rotation shaft.

The support rib may be extended from the inner circumferential surface of the circumferential rib toward the rotation center side by side with an extended direction of the first body arm.

A plurality of the support ribs may be provided to be connected to each other at the rotation center by being extended from different points on the inner circumferential surface of the circumferential rib to the rotation center.

A plurality of the support ribs may be spaced apart from each other by a same angle.

The first body arm may increase in thickness at the connecting point in an axial direction of the rotation shaft if getting closer to the first body hub.

And, the second body arm may increase in thickness at the connecting point in the axial direction of the rotation shaft if getting closer to the second body hub.

Accordingly, the present disclosure provides the following effects and/or advantages.

The present disclosure may provide a connector capable of minimizing the remaining foreign substance and a laundry treating apparatus provided with the connector.

The present disclosure may provide a connector capable of transmitting a rotational power provided by a motor stably and a laundry treating apparatus provided with the connector.

The present disclosure may provide a connector capable of minimizing weight of its own and a laundry treating apparatus provided with the connector.

The present disclosure may provide a connector capable of maximizing durability as well as minimizing weight of its own and a laundry treating apparatus provided with the connector.

And, the present disclosure may provide a connector capable of preventing a stress concentration site from being broken or damaged and a laundry treating apparatus provided with the connector.

Effects obtainable from the present disclosure may be non-limited by the above-mentioned effects. And, other unmentioned effects can be clearly understood from the following description by those having ordinary skill in the technical field to which the present disclosure pertains.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. The above and other aspects, features, and advantages of the present disclosure will become more apparent upon consideration of the following description of preferred embodiments, taken in conjunction with the accompanying drawing figures. In the drawings.

DETAILED DESCRIPTION

Reference will now be made in detail to the preferred embodiments of the present disclosure, examples of which are illustrated in the accompanying drawings, in order to facilitate implementation of embodiments of the present disclosure by those skilled in the art to which the present disclosure pertains.

Meanwhile, elements or control method of apparatuses which will be described below are only intended to describe the embodiments of the present disclosure and are not intended to restrict the scope of the present disclosure. Wherever possible, the same reference numbers will be used throughout the drawings to refer to the same or like parts.

In the present specification, duplicate descriptions of the same components are omitted.

It will be understood that when an element is referred to as being "connected with" another element in the present specification, the element can be directly connected with the other element or intervening elements may also be present. In contrast, when an element is referred to as being "directly connected with" another element, there are no intervening elements present.

In addition, the terms used in this specification are used only to describe specific embodiments, not to limit the present disclosure.

In addition, a singular representation may include a plural representation unless it represents a definitely different meaning from the context.

In the present application, terms such as "include" or "has" are used herein and should be understood that they are intended to indicate an existence of several components, functions or steps, disclosed in the specification, and it is also understood that greater or fewer components, functions, or steps may likewise be utilized.

In addition, the terms 'and/or' in the present specification include a combination of multiple entries described herein or any of them. In the present specification, 'A' or 'B' may include 'A', 'B', or 'both A and B'.

Hereinafter, preferred embodiments of the present disclosure will be described in detail with reference to the accompanying drawings. Meanwhile, the configuration or control method of the device, which will be described below, is for describing an embodiment of the present invention only but not for limiting the scope of the present disclosure, and reference numbers equally used throughout the specification denote the same components.

Figure 1:
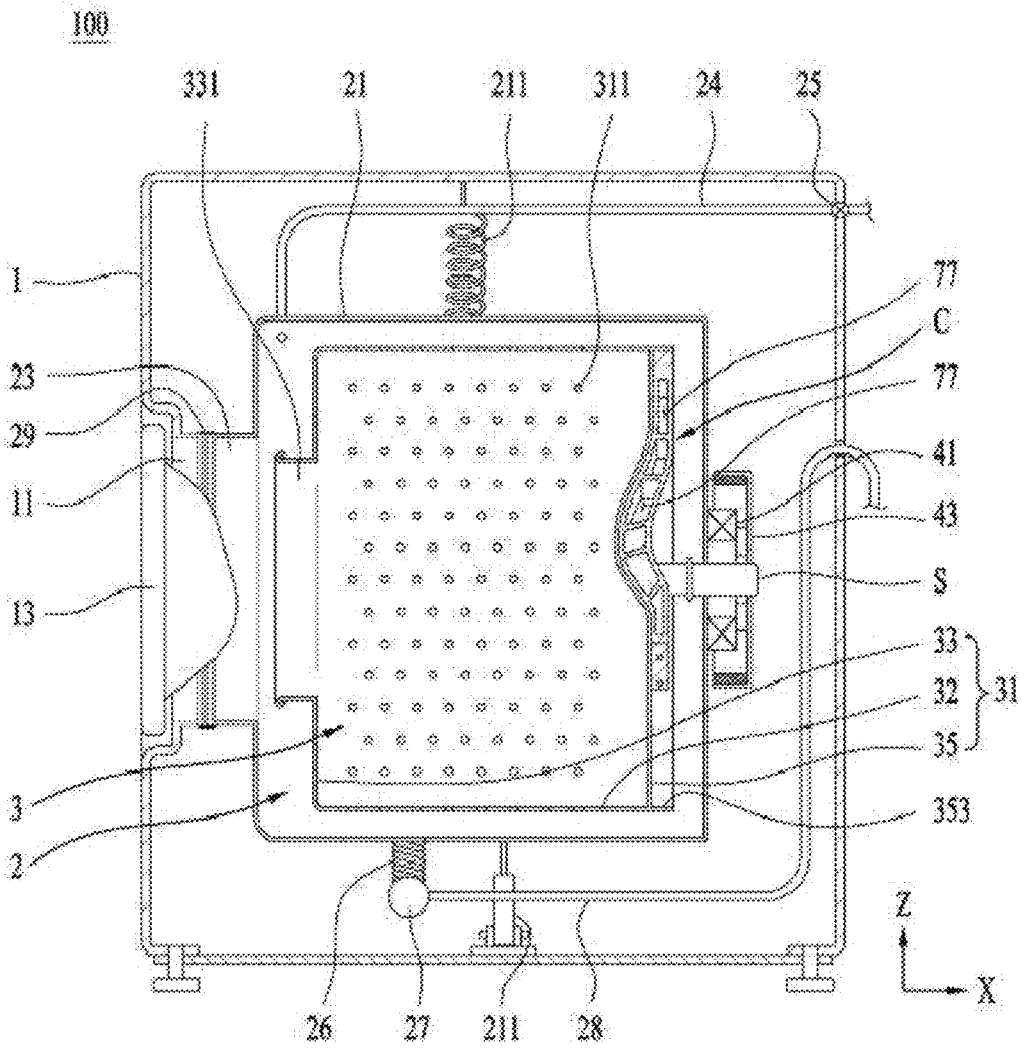
FIG. 1 is a diagram showing a laundry treating apparatus according to one embodiment of the present disclosure.

As shown in FIG. 1, a laundry treating apparatus 100 according to the present disclosure includes a cabinet 1, a tub 2 provided within the cabinet 1 to store water therein, and a drum 3 rotatably provided within the tub 2 to store laundry therein.

An entrance 11 for inserting or withdrawing laundry is provided to a front side of the cabinet 1. The entrance 11 is open/closed by a door 13 rovolvably coupled to the cabinet 1.

The tub 2 may include a tub body 21 in a hollow cylindrical shape. The tub body 21 is fixed to an inside of the cabinet 1 through a tub support part 211. The tub support part 211 may be configured to absorb vibration generated from the tub body 21. In this case, the tub support part 211 may include a spring connecting a top side of the tub body 21 to the cabinet 1 and a damper connecting a bottom region of the tub body 21 to the cabinet 1.

A tub entrance 23 is provided to a front side (i.e., a side located in a direction facing the entrance in a space of forming the tub body) of the tub body 21. The tub entrance 23 and the entrance 11 are connected together via a gasket 29 (rubber material) in an approximately cylindrical shape.

The tub body 21 is supplied with water via a water supply part, and the water stored in the tub body 21 is discharged from the cabinet 1 through a drain part. The water supply part includes a water supply pipe 24 connecting a water supply source and the tub body 21 together and a water supply valve 25 opening or closing the water supply pipe 24 in response to a control signal of a controller (not shown).

The drain part may include a first drain pipe 26 guiding the water stored in the tub body 21 to a pump 27 and a second drain pipe 28 guiding the water discharged from the pump 27 to an outside of the cabinet 1.

The drum 3 may include a drum body 31 in a hollow cylindrical shape. Namely, the drum body 31 may include a circumferential surface 32 having both open sides confronting each other, a first surface 33 forming a front side of the drum body by being fixed to the circumferential surface and a second surface 35 forming a rear side of the drum body by being fixed to the circumferential surface.

A drum opening 331 for inserting laundry supplied through the tub entrance 23 into the drum body 31 is provided to the first surface 33. A multitude of holes 311 configured to enable an inside of the drum body 31 to communicate with an inside of the tub body 21 are provided to the drum body 31, the first surface 33 and the second surface 35.

The drum 3 is supplied with power provided by a motor 41 and 43 via a connector C. The motor may include a stator 41 located outside the tub body 21 to form a rotating field and a rotor 43 rotated by the rotating field. The stator 41 may be fixed to a backside of the tub body 21.

The connector C may include a rotation shaft S connecting the rotor 43 and the drum body 31 together only. In this case, as the rotation shaft S is configured to penetrate a backside of the tub body 21, one side of the rotation shaft S may be fixed to the second surface 35 of the drum body and the other side may be fixed to the rotor 43.

Figure 2:
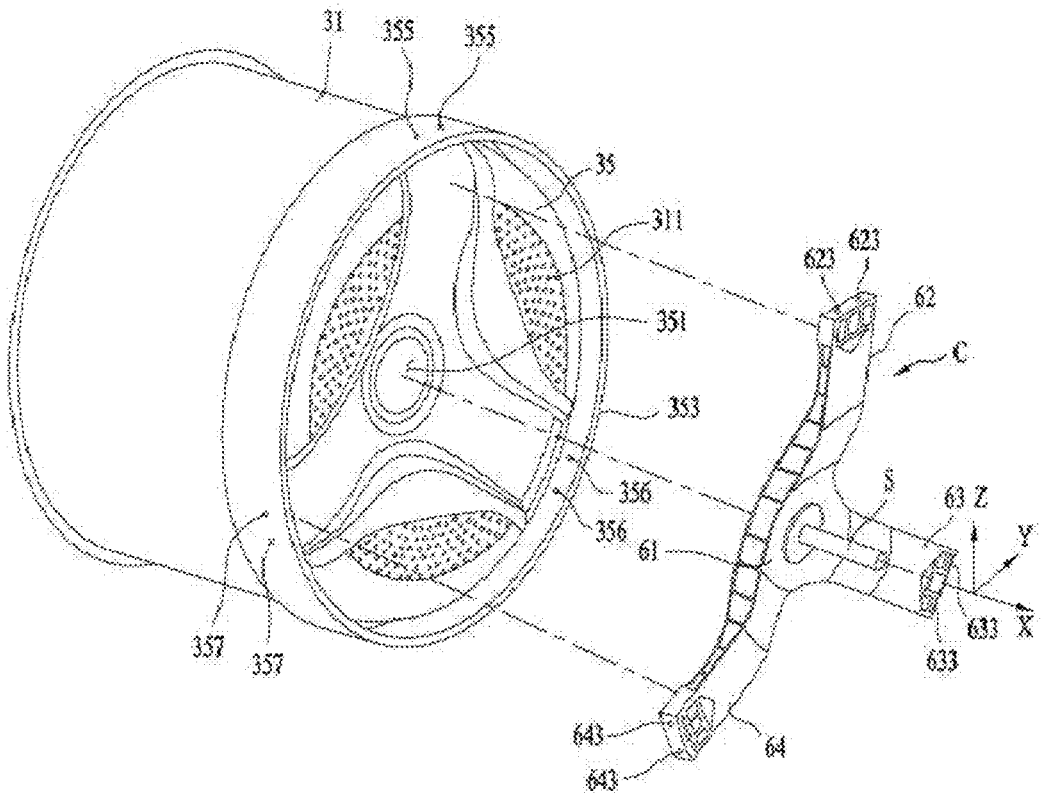
FIG. 2 is a diagram showing a coupling structure of a drum and connector according to one embodiment of the present disclosure.

Yet, if the rotation shaft S is directly connected to the second surface 35 of the drum body, when the rotation shaft S rotates, stress is concentrated on the second surface 35, the possibility of breakage of the second surface 35 may increase. Therefore, as shown in FIG. 2, the connector C may further include a hub 61 having the rotation shaft S fixed thereto and an arm 62/63/64 projected from the hub 61 toward an edge of the second surface.

The arm may include a single arm projected from the hub toward the edge of the second surface or two or more arms. In case that two or more arms are provided to the connector C, they are preferably spaced apart from each other at the same angle with reference to the hub 61. FIG. 2 illustrates a case that the arm includes three arms. In this case, the arm may include a first arm 62, a second arm 63 and a third arm 64, which are spaced apart from with each other by 120 degrees each with reference to the hub 61. Here, if a plurality of arms are spaced apart from each other by 120 degrees, it may means that extension directions in which the arms 62 to 63 are extended from the hub 61 are spaced apart from each other by 120 degrees.

In order to facilitate a rotational force, which is provided by the connector C, to be transmitted to the drum body 31, a connector receiving recess 351 may be provided to the second surface 35. The connector receiving recess 351 may include a recess (i.e., a recess formed in a manner that the rear side of the drum is concavely recesses toward the front side of the drum) recessed concavely toward a direction in which the first surface 33 is located. The connector receiving recess 351 may be configured in a shape corresponding to the shapes of the hub 61 and the three arms 62 to 64. Therefore, the present disclosure may stably transmit the rotational power provided by the motor to the drum.

In order to fix the connector C to the drum body 31, a fastening rib 353 may be further provided to the drum 3. The fastening rib 353 may include a cylindrical pipe fixed to the drum body 31 or the second surface 35. The fastening rib 353 may be projected backward from the second surface 35. First to third perforated holes 355 to 357 may be provided to the fastening rib.

A first fastening recess 623 may be provided to a free end of the first arm 62, a second fastening recess 633 may be provided to a free end of the second arm 63, and a third fastening recess 643 may be provided to a free end of the third arm 64. The fastening recesses 623, 633 and 643 may be configured in a manner of being recessed into the arms 62, 63 and 64, respectively.

The first arm 62 may be fixed to the drum 3 by a bolt fastened to the first fastening recess 623 by penetrating the first perforated hole 355. The second arm 63 may be fixed to the drum 3 by a bolt fastened to the second fastening recess 633 by penetrating the second perforated hole 356. The third arm 64 may be fixed to the drum 3 by a bolt fastened to the third fastening recess 643 by penetrating the third perforated hole 357.

Figure 3A:
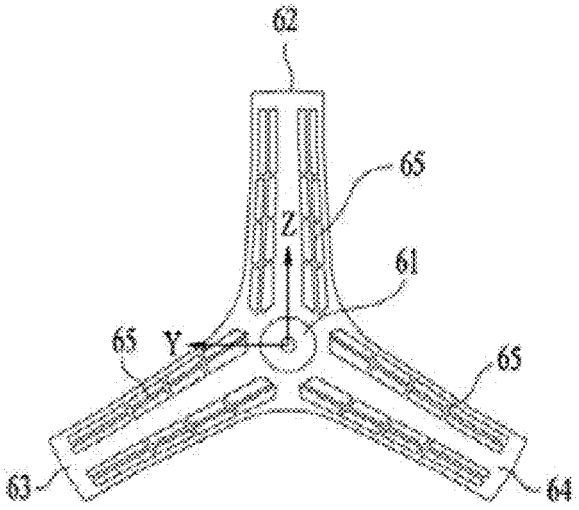
FIGS. 3A and 3B are diagrams showing a connector according to one embodiment of the present disclosure.

As shown in FIG. 3A, to reinforce the rigidity of the connector C, a rigidity reinforcement part 65 may be further provided to a surface, which contacts with the second surface 35, in a space provided by the connector.

Figure 3B:
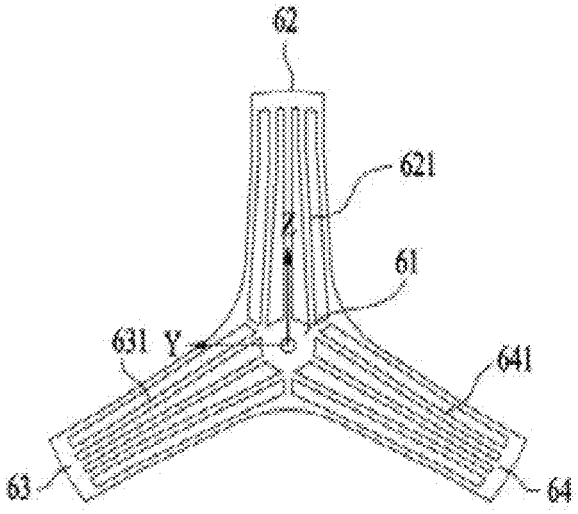

The rigidity reinforcement part 65 may be configured in a manner that a multitude of boards cross with each other to form a lattice structure In addition, the rigidity reinforcement part 65 may be configured as shown in FIG. 3B. Namely, as shown in FIG. 3B, the rigidity reinforcement part may include a first arm rib 621 provided along a length direction (Z-axis direction) of the first arm 62, a second arm rib 631 provided along a length direction of the second arm 63, and a third arm rib 641 provided along a length direction of the third arm 64.

The first arm rib 621 may include a multitude of boards spaced apart from each other along a width direction Y of the first arm 62, the second arm rib 631 may include a multitude of boards spaced apart from each other along a width direction of the second arm 64, and the third arm rib 641 may include a multitude of boards spaced apart from each other along a width direction of the third arm 64. Regarding the connector C according to the present embodiment, although foreign substances and the like flow into a space between the boards, since the boards are configured along the length direction of each of the arms, the foreign substances and the like may be discharged from the connector C while the drum is rotating.

Figure 4:
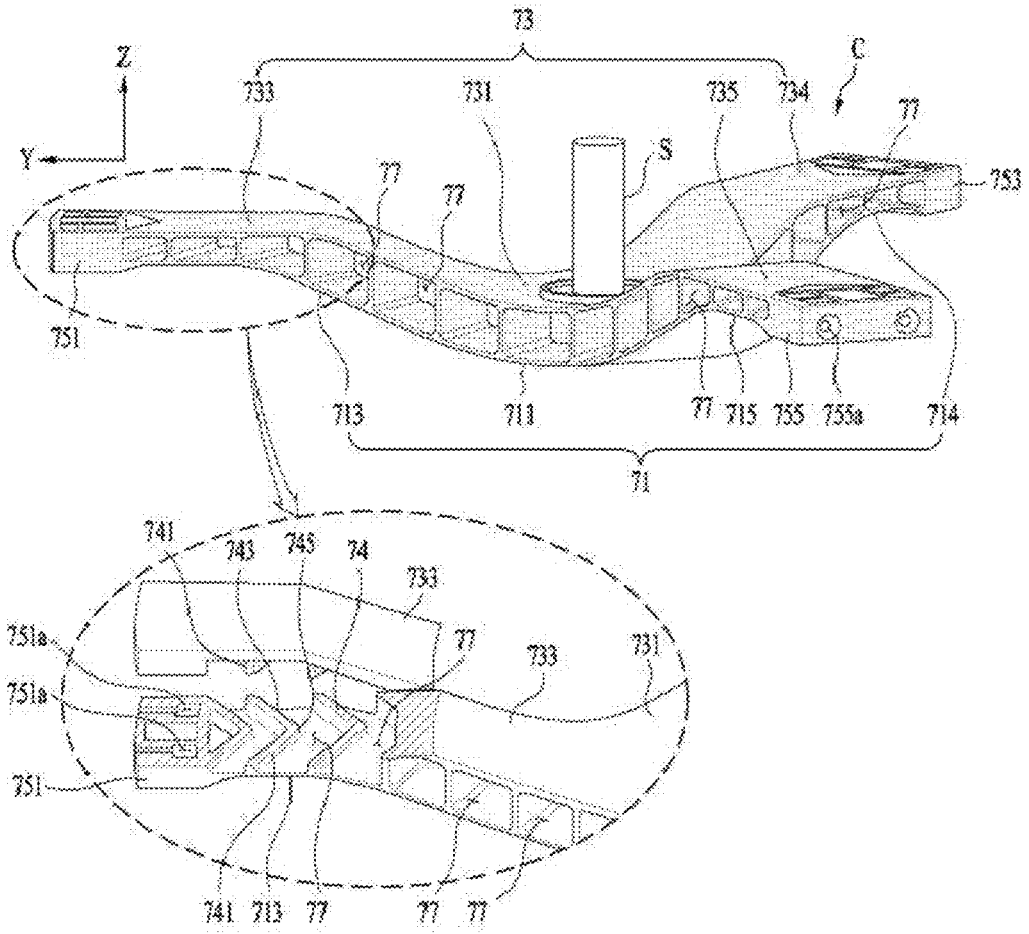
FIG. 4 is a diagram showing a connector and a connecting part of the connector according to one embodiment of the present disclosure.

FIG. 4 shows another embodiment of a connector C. Regarding the connector C according to the present embodiment, foreign substances and the like remaining in the connector C may be washed out by the water stored in the tub 2 during the rotation of the drum 3.

Namely, the connector C according to the present embodiment may include a first body 71 fixed to the second surface 35 (i.e., a rear side) of the drum, a second body 73 having the rotation shaft S fixed thereto, and a connecting part 74 connecting the first body 71 and the second body 72 together. The connecting part 74 may maintain a state that the first body 71 and the second body 72 are spaced part from each other. Moreover, the connecting part 74 may form a flow path to enable water to flow in a space between the first body 71 and the second body 72.

The first body 71 may include a first body hub 711 located at a rotation center of the drum 3 and first body arms 713, 714 and 715 extended from the first body hub 711 toward the edge of the second surface 35.

The second body 73 includes a second body hub 731 located within the tub 2 to have the rotation shaft S fixed thereto and second body arms 733, 734 and 735 extended from the second body hub 731 in the same direction as the first body arm extended direction. The second body arms 733 to 735 may be extended from the second body hub 731 side by side with the first body arms 713 to 715, respectively. The second body hub 731 may be configured n the same shape of the first body hub 711 so as to be side by side with the first body hub 711.

The first body arm may include only a first body first arm 713 extended from the first body hub 711 toward the edge of the second surface 35, and the second body arm may include only a second body first arm 733 extended from the second body hub 731 along a direction in which the first body first arm 713 is extended from the first body hub 711.

In this case, the connecting part 74 may include a first connecting body 741 configured to incline downward from a left end of the first body first arm 713 toward the rotation shaft S and a second connecting body 743 configured to incline downward from a right end of the first body first arm 713 toward the rotation shaft S.

In each of the first connecting body 741 and the second connecting body 743, one end may be fixed to the first body first arm 713 and the other end may include a board connected to the second body first arm 733.

Yet, one end of the first connecting body 741 and one end of the second connecting body 743 may be configured not to be connected to each other, or may be configured to each other at a connecting point 745. FIG. 4 illustrates a case that two connecting bodies 741 and 743 meet each other at the connecting point 745 for example. In any cases, the connecting part 74 will be configured in a V-shape pointed toward the rotation shaft S.

If the connecting part 74 is configured in a V-shape pointed toward the rotation shaft S, the connector C can support a force acting in a width direction (Y-axis direction) of the first body first arm 713, a force acting in a length direction (Y-axis direction) of the first body first arm 713, and a force acting in a thickness direction (Z-axis direction) of the connector all. Therefore, the present disclosure may provide the connector C having high rigidity and transmit a rotational power provided by the motor to the drum stably.

Although not shown in the drawing, the connecting part 74 may be configured in a V-shape pointed in a direction moving away from the rotation shaft S. Namely, the connecting part 74 may include a first connecting body 741 inclined upward from the left end of the first body first arm 713 toward a direction moving away from the rotation shaft S and a second connecting body 743 inclined upward from the right end of the first body first arm 713 toward a direction moving away from the rotation shaft S. In addition, the connecting part 74 may include a connecting body in a shape side by side with a width direction (e.g., a direction orthogonal to a direction from a rotation shaft toward a free end of the first body first arm) of the first body first arm 713.

Furthermore, the connecting part 74 may include a connecting body in a board shape provided along the width direction Y of the first body first arm 713 and curved toward the rotation shaft located direction (e.g., −Z-axis direction) or curved at a predetermined curvature toward a direction (e.g., +Z-axis direction) moving away from the rotation shaft S.

A multitude of the above-structured connecting parts 74 may be provided. Preferably, the connecting parts 74 are disposed in a manner of being spaced apart from each other along a length direction (e.g., Z-axis direction, a direction facing the free end of the first body first arm from the rotation shaft) of the first body first arm 713. This is to form a flow path 77, on which water moves, in a space between the connecting parts 74.

In addition, the first connecting body provided to one connecting part and the first connecting body provided to another connecting part may be configured side by side with each other, and the second connecting body provided to one connecting part and the second connecting body provided to another connecting part may be configured side by side with each other. This is to enhance manufacturing facilitation in manufacturing a connector using a mold.

During the rotation of the drum (e.g., the rotation of the rotor, the rotation of the connector), water stored in the tub may move along the flow path 77 formed by the connecting part 74. Therefore, the present disclosure may minimize that foreign substances and the like discharged from laundry remain on the connector C and wash out foreign substances remaining on the connector C.

Regarding the above-configured connector C, weight of the connector can be minimized owing to the flow path 77 formed by the connecting part 74, thereby minimizing energy supposed to be supplied to the motor owing to the weight of the connector (i.e., minimizing energy required for rotation of the drum).

Regarding the connector C, the first body arm may include the first body first arm 713 only and the second body arm may include the second body first arm 733 Alternatively, the first body arm may include the first body first body arm 713, the first body second arm 714 and the first body third arm 715 and the second body arm may include the second body first arm 733, the second body second arm 734 and the second body third arm 735. In order to transfer the rotation of the rotation shaft S more effectively, three first body arms 713 to 715 and three second body arms 733 to 735 are preferably provided.

As shown in FIG. 4, the first body arms may include the first body first arm 713 extended from the first body hub 711 toward the edge of the second surface 35, the first body second arm 714 extended from the first body hub 711 toward the edge of the second surface 35, and the first body third arm 715 extended from the first body hub 711 toward the edge of the second surface 35. In this case, the first body arms 713 to 715 are preferably spaced apart from each other at the same angle (120 degrees) centering on the rotation shaft S.

The second body arms may include the second body first arm 733 extended from the second body hub 731 along the same direction in which the first body first arm 713 is extended from the first body hub 711, the second body second arm 734 extended from the second body hub 731 along the same direction in which the first body second arm 714 is extended from the first body hub 711, and the second body third arm 735 extended from the second body hub 731 along the same direction in which the first body third arm 715 is extended from the first hub 711. Namely, the second body arms 733 to 735 may be configured to confront the first body arms 713 to 715, respectively.

The free end of the first body first arm 713 and the free end of the second body first arm 733 may be connected together by a first fastening body 751. A first fastening recess 751*a* communicating with the first perforated hole 355 provided to the fastening rib 353 may be provided to the first fastening body.

Likewise, a second fastening recess 753*a* communicating with the second perforated hole 356 may be provided to the second fastening body 753 connecting the free end of the first body second arm 714 and the free end of the second body second arm 734 together, and a third fastening recess 755*a* communicating with the third perforated hole 357 may be provided to the third fastening body 755 connecting the free end of the first body third arm 715 and the free end of the second body third arm 735 together.

The connecting part 74 includes a first arm connecting part connecting the first body first arm 713 and the second body first arm 733 together, a second arm connecting part connecting the first body second arm 714 and the second body second arm 734 together, and a third arm connecting part connecting the first body third arm 715 and the second body third arm 735 together.

The structure of the first arm connecting part, the structure of the second arm connecting part and the structure of the third arm connecting part may have the same configurations described above.

Namely, the first arm connecting part may include the first connecting body 741 and the second connecting body 743 connecting the first body first arm 713 and the second body first arm 733 together, the second arm connecting part may include the first connecting body and the second connecting body connecting the first body second arm 714 and the second body second arm 734 together, and the third arm connecting part may include the first connecting body and the second connecting 43 connecting the first body third arm 715 and the second body third arm 735 together.

Figure 5:
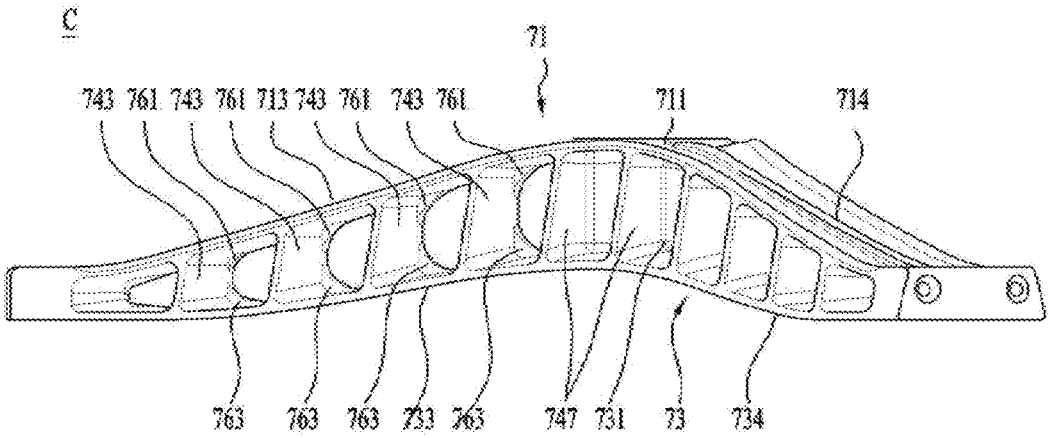
FIG. 5 is a diagram showing a lateral view of a connector according to one embodiment of the present disclosure.

FIG. 5 shows a structure of a connector according to one embodiment of the present disclosure in detail with respect to the connector having the above-described structure. Although FIG. 4 shows the state that the first body 71 faces downward, FIG. 5 shows a state that the first body 71 faces upward. In the following description, the first body 71 is illustrated as facing upward in the drawing. Namely, FIG. 5 shows a state that the connector shown in FIG. 4 is turned upside down.

Hereinafter, when the first body arms 713 to 715 and the second body arms 733 to 735 are described, they will be described with reference to the first body first arm 713 and the second body first arm 733. In case that first body arms 713 to 715 include the first body first arm 713, the first body second arm 714 an the first body third arm 715, the same description of the third body first arm 713 will apply to the first body second arm 714 and the first body third arm 715. The second body arms 733 to 735 may be understood as the same.

Referring to FIG. 2 and FIG. 5, the connector C of the laundry treating apparatus according to one embodiment of the present disclosure may include the first body 71 including the first body hub 711 located at the rotation center of the drum by being fixed to the second surface 35 and the first body arm 713 extended from the first body hub 711 toward the edge of the second surface, the second body 73 including the second body hub 731 located within the tub so as to have the rotation shaft S of the drum 3 fixed thereto and the second body arm 733 extended from the second body hub 731 along the same direction having the first body arm 713 extended from the first body hub 711 therein, and the connecting part 74 configured to connect the first body 71 and the second body 73 together to maintain a state having the first body 71 and the second body 73 spaced apart from each other therein. For the details of the first body 71, the second body 73 and the connecting part 74, the former description may be referred to.

The connector C includes a reinforcement rib 76 extended from the connecting part 74 in a length direction of the first body arm 713 to connect the connecting part 74 and the first body arm 713 or the second body arm 733 together and to reinforce the coupling strength of the connecting part 74 and the first body arm 713 or the second body arm 733.

As shown in FIG. 5, the reinforcement rib 76 may be configured to connect the connecting part 74 and the first body arm 713 or the second body arm 733 together by being extended from a specific portion of the connecting part 74, by which the present disclosure is non-limited. Alternatively, the reinforcement rib 76 may be connected to the first body arm 713 or the second body arm 733 by being extended from several points of the connecting part 74.

In case that the connecting part 74 connects the first body arm 713 and the second body arm 733 together, since the point at which the connecting part 74 and the first/second body arm 713/733 is connected has an insufficient connection area in comparison to a length of the first body arm 713, it is vulnerable to a shearing force in the extension direction of the first body arm 713. Hence, if the shearing force is applied, the connection between the connecting part 74 and the first/second body arm 713/733 may be released possibly. Namely, if the drum rotates while receiving laundry therein, a great shearing force is generated to break or damage the connector C possibly.

Therefore, in case that the reinforcement rib 76 is extended from the connecting part 74 and connected to the first body arm 713 or the second body arm 733, the reinforcement rib 76 may substantially increase the contact area between the connecting part 74 and the first body arm 713. Since the connecting part 74 and the reinforcement rib 76 can support the first body arm 713 simultaneously, it brings an effect that the connecting part 74 is prevented from being broken or damaged by the shearing force.

Although FIG. 5 shows that the reinforcement rib 76 is extended from the connecting part 74 toward the first body hub 711, the reinforcement rib 76 may be configured in a manner of being extended from the connecting part 74 in a direction moving away from the first body hub 711.

Figure 6:
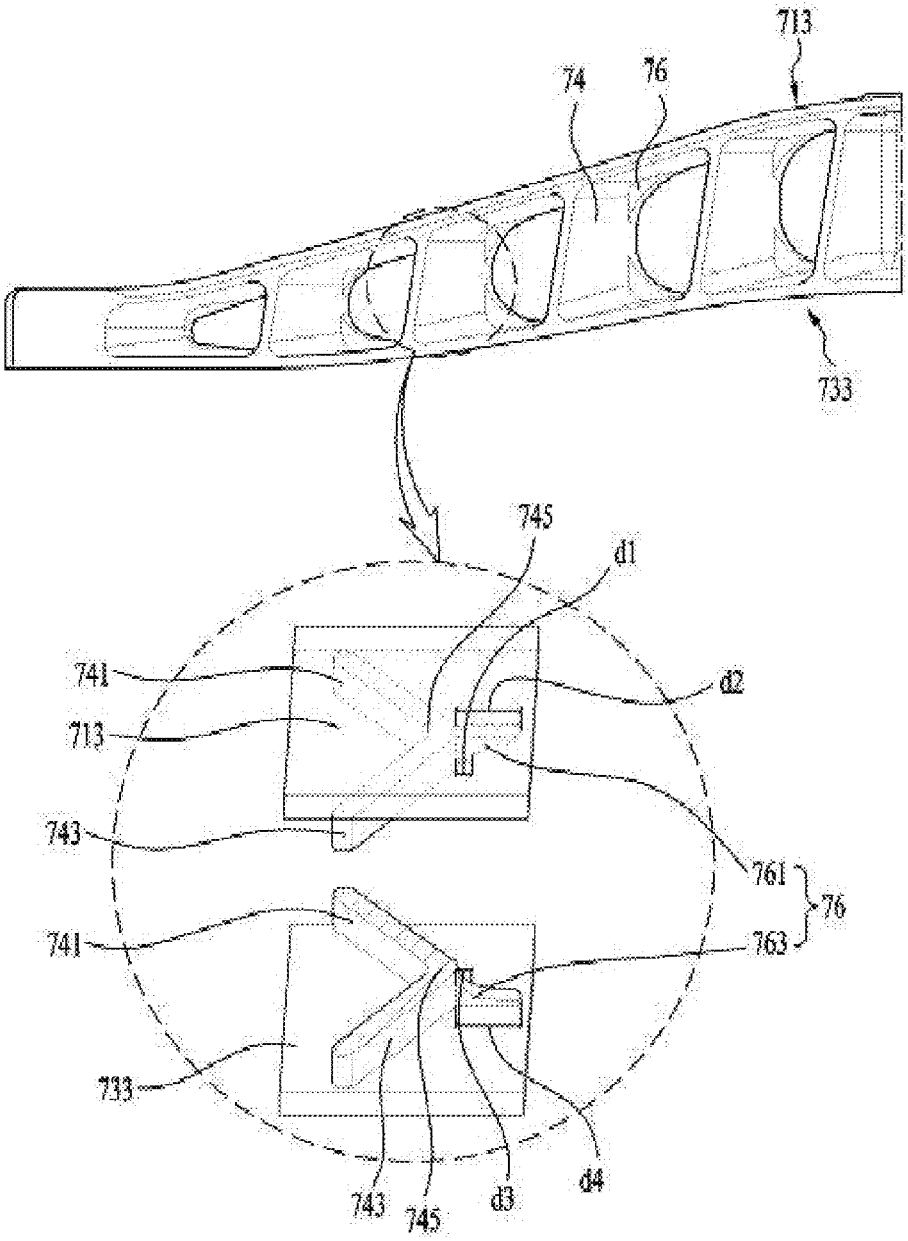
FIG. 6 is a diagram showing a connector and a reinforcement rib of the connector according to one embodiment of the present disclosure.

To obtain the overall structure of the connecting part and the reinforcement rib of the connector, FIG. 6 shows that a portion located adjacent to the first body and a portion located adjacent to the second body are randomly separated. The connecting part is not actually separated like FIG. 6. Instead, upper and lower portions of the connecting part may be formed as an integral part.

Referring to FIG. 6, the connecting part 74 may include a first connecting body 741 inclined from one of both confronting ends of the first body arm 713 toward the rotation shaft S to connect the first body arm 713 and the second body arm 733 together, a second connecting body 743 inclined from the other end of the first body arm toward the rotation shaft to connect the first body arm 713 and the second body arm 733 together, and a connecting point 745 having the first and second connecting bodies 741 and 743 connected together thereat.

As the first connecting body 841 and the second connecting body 743 are inclined toward the rotation shaft S, a contact area between the first body arm 713 and the second body arm 733 may increase more in comparison to a case that the first and second connecting bodies are configured side by side with each other from one end of the first body arm toward the other end. Hence, it is advantageous in preventing occurrence of breakage due to a shearing force acting in an extension direction of the first body arm 713.

In addition, as the first connecting body 741 and the second connecting body 743 are configured to be connected together at the connecting point 745, a force applied to the first connecting body 741 may be partially supported by the second connecting body 743, or a force applied to the second connecting body 743 may be partially supported by the first connecting body 741. Therefore, it brings an effect that the coupling strength of the connecting part 74 and the first and second body arms 713 and 733 is increased.

In addition, the connecting point 745 may be located closer to the rotation shaft S than the first connecting body 741 or the second connecting body 743 located in a direction moving away from the connecting point 745. Namely, the connecting point 745 may be located closer to the rotation shaft S than one end of the first body arm 713 having the first connecting body 741 connected thereto or the other end of the first body arm 713 having the second connecting body 743 connected thereto. If the connecting point 745 is located as described above, the connecting part 74 may be configured in a shape that a vertex of 'V' is located toward the rotation shaft S.

If the connecting part 74 is configured in a shape that a vertex of 'V' is located toward the rotation shaft S, the connector C can support a force acting in a width direction of the first body first arm 713, a force acting in a length direction of the first body first arm 713, and a force acting in a thickness direction of the connector all. Therefore, the present disclosure may provide the connector C having high rigidity and transmit a rotational power provided by the motor to the drum stably.

In some implementations, as shown in FIG. 6, the reinforcement rib 76 is extended from the connecting point 745 toward the rotation shaft S, thereby connecting the connecting point 745 and the first or second body arm 713 or 733 together.

Namely, the connecting part 74 may include a vertex of a V-shape is located toward the rotation shaft S and connect the connecting point 745 located at the vertex of the V-shape to the first body arm 713 or the second body arm 733. Since the connecting point 745 may be located at the vertex of the V-shape, a length-directional stress and a width-directional stress of the first body arm 713 may be concentrated on the connecting point 745. Therefore, as a stress greater than a stress applied to the first or second connecting body 741 or 743 is concentrated on the connecting point 745, the risk of breakage or damage is raised.

Thus, it is important to raise the rigidity of the corresponding portion in increasing rigidity of the connector C and improving durability. Therefore, as the reinforcement rib 76 is extended from the connecting point 745, if the first body arm 713 or the second body arm 733 is extended, it brings an effect that a stress applied to the connecting point 745 can be distributed.

In addition, since the connecting point 745 is provided closer to the rotation shaft S than the first or second connecting body 741 or 743, extending the reinforcement rib 76 from the connecting point 745 toward the rotation shaft S is more efficient to reinforce the rigidity of the connecting point 745 than extending the reinforcement rib 76 in a direction of moving away from the rotation shaft S.

Referring to FIG. 6, it may be confirmed that the connecting point is located at the center of the first connecting body 741, the second connecting body 743 and the reinforcement rib 76. Namely, centering around the connecting point 745, the first connecting body 741, the second connecting body 743 and the reinforcement rib 76 may be extended radially. The first connecting body 741, the second connecting body 743 and the reinforcement rib 76 may be configured to be spaced apart from each other at the same angle. In this configuration, they may support the connecting point 745 in a manner of being spaced by 120 degrees each, by which the present disclosure is non-limited. Alternatively, various structures capable of supporting the connecting point 745 by the first connecting body 741, the second connecting body 743 and the reinforcement rib 76 may be applicable.

A plurality of the connecting parts 74 may be provided. A plurality of the connecting parts 74 are spaced apart from each other along the length direction of the first body arm 713, thereby connecting the first body arm and the second body arm together.

In caser that a plurality of the connecting parts 74 are provided in a manner of being spaced apart from each other along the length direction of the first body arm 713, the first body arm 713 and the second body arm 733 may be supported by a plurality of the connecting parts 74. Therefore, it brings an effect that the coupling strength of the first and second body arms 713 and 733 is increased.

In case that a plurality of the connecting parts 74 are provided in a manner of being spaced apart from each other, weight of material corresponding to a space between the spaced connecting parts 74 can be reduced. Hence, a less force is necessary to rotate the connector C and a power amount used by the motor in rotating the connector C may be reduced. Namely, there is an effect that power consumption of the laundry treating apparatus 100 is reduced.

In addition, since water used in a washing course may flow through the flow path 77 formed between the connecting parts 74, it brings an effect that foreign substances are prevented from remaining on the connector C.

Meanwhile, in caser that a plurality of the connecting parts 74 are provided, each of the connecting parts 74 may include the first connecting body 741, the second connecting body 743 and the connecting point 745, and the reinforcement rib 76 may be provided to each connecting point 745.

In a state that a plurality of the connecting parts 74 and the reinforcement ribs 76 are provided, the reinforcement rib 76 extended from one connecting part 74 may be spaced apart from another connecting part 74 along the length direction of the first body arm 713.

When the one connecting part 74 and the another connecting part 74 are referred to as a first connecting part and a second connecting part, assuming that the second connecting part is located closer to the rotations shaft than the first connecting part, the reinforcement rib 76 extended from the first connecting part toward the rotation shaft may be provided in a manner of being spaced apart from the second connecting part.

Namely, the reinforcement rib 76 may be configured to connect the connecting part 74 and the first or second body arm 713 or 733 together but not to connect one connecting part 74 to anther connecting part 74. If the reinforcement rib 76 is configured to connect one connecting part 74 and another connecting part 74 together, a sill located in a space between the connecting parts 74 may be formed. If the sill is formed, foreign substances such as dust, lint and the like, which are generated during a washing course, may be caught on the sill. If so, wash efficiency may be lowered and hygienic problems may be caused.

Yet, if the reinforcement rib 76 is extended from one connecting part 74 but is spaced apart from another connecting part 74, the sill is not formed and foreign substances contained in wash water can flow naturally along the flow of the wash water, thereby raising wash efficiency and preventing the hygienic problems.

In addition, since the reinforcement rib 76 is extended from the connecting point 745, it is able to support the connecting point 745 at which the first and second connecting parts 741 and 743 meet each other. Thus, as described above, if the reinforcement rib 76 is extended from the connecting point 745 in a direction of the rotation shaft, it will be effective for rigidity reinforcement.

Yet, if the reinforcement rib 76 is extended from one connecting point 745 to another connecting point 745 provided closer to the rotation shaft, the reinforcement rib 76 results in being extended from the another connecting point 745 in a direction of moving away from the rotation shaft S. Thus, if the reinforcement rib 76 is extended from the connecting point 745 in the direction of moving away from the rotation shaft, it may reinforce the rigidity of the connecting part 74.

Therefore, if the reinforcement rib 76 is extended from one connecting point 745 and is spaced apart from another connecting point 745 provided closer to the rotation shaft, the unnecessary waste of material can be prevented while the effect of reinforcing the rigidity of the connecting part 74 is maximized. Thus, a connector of high durability can be provided while total weight of the connector C is reduced.

Although the above description is made with reference to the laundry treating apparatus of the front-loading type, the present disclosure is also applicable to a laundry treating apparatus of a top-loading type. In this case, the entrance 11 may be provided to the topside of the cabinet, the tub entrance 23 may be provided to the topside of the tub body in cylindrical shape, the first surface provided with the drum opening may become the topside of the drum body, and the second surface having the first body 71 of the connector fixed thereto may become the bottom side of the drum body 31.

As the present disclosure may be modified and implemented in various forms, the scope of the appended claims and their equivalents of the present disclosure is not limited to the above-described embodiments. Therefore, if the modified embodiment includes the components of the claims of the present disclosure, it should be regarded as pertaining to the scope of the appended claims and their equivalents of the present disclosure.

In some implementations, an extended length of the reinforcement rib 76 extended from one connecting point 745 may be smaller than a spaced distance between one connecting point 745 and another connecting point 745. If the reinforcement rib 76 is configured in a manner that an extended length of the reinforcement rib 76 extended from the connecting point 745 is smaller than a spaced distance between the connecting points 745, the reinforcement rib 76 is prevented from connecting a space between two adjacent connecting points 745.

According to the above configuration, the reinforcement rib 76 extended from one connecting point 745 and another connecting point 745 may be spaced apart from each other. If the reinforcement rib 76 is configured in this manner, the rigidity of the connecting point 745 can be reinforced while the total weight of the connector C is reduced. Moreover, it is able to prevent a problem that foreign substances remain in a space formed between one connecting part 74 and another connecting part 74.

In some implementations, the reinforcement rib 76 may include a first reinforcement body 761 connecting the connecting point 745 and the first body arm 713 together and a second reinforcement body 763 connecting the connecting point 745 and the second body arm 733 together. The first reinforcement body 761 and the second reinforcement body 763 may be configured in a manner of being spaced apart from each other along an axial direction of the rotation shaft S.

Namely, the reinforcement rib 76 may include a first reinforcement body 761 provided to the side of the first body arm 713 and a second reinforcement body 763 provided to the side of the second body arm 733. The first reinforcement body 713 and the second reinforcement body 763 may be provided in a manner of being spaced apart from each other along a height direction of the connection part 74, i.e., a direction in which the first and second body arms 713 and 733 are spaced apart from each other.

Specifically, the first reinforcement body 713 and the second reinforcement body 763 are extended from the connecting point 745, the first reinforcement body 713 may connect the connecting point 745 and the first body arm 713 together, and the second reinforcement body 763 may connect the connecting point 745 and the second body arm 733 together.

A specific point of the connecting point 745 having the first reinforcement body 761 extended therefrom and a specific point of the connecting point 745 having the second reinforcement body 763 extended therefrom may be provided in a manner of being spaced apart from each other. Namely, various portions of the connecting point 745 may be divided into a portion having the first reinforcement body 761 extended therefrom, a portion having the second reinforcement body 763 extended therefrom, and a portion having the first and second reinforcement bodies 761 and 763 not extended therefrom.

The connecting point 745 may receive the greatest stress at a portion contacting with the first body arm 713 or the second body arm 733, whereby the corresponding portion is frequently broken or damaged. Therefore, it is important to reinforce the contact portion between the connecting point 745 and the first or second body arm 713 or 733.

Yet, the reinforcement rib 76 may reinforce the connecting point 745 overall. For example, the reinforcement rib 76 may reinforce the connecting point 745, the first body arm 713 and the second body arm 733, and the reinforcement rib 76 itself may also connect the first body arm 713 and the second body arm 733 together. Namely, the reinforcement rib 76 is extended from the connecting point 745 and configured to connect the first body arm 713 and the second body arm 733 together.

Yet, according to the above configuration, at a portion relatively distant from the contact portion between the connecting point 745 and the first or second body arm 713 or 733 and a point located in the middle between the first and second body arms 713 and 733, the effect for the reinforcement rib 76 to reinforce the rigidity of the connecting part 74 may be limited.

Therefore, in order to support the connecting point 745 most effectively and reinforce the coupling of the connecting part 74, it is efficient to intensively reinforce the contact point between the connecting point 745 and the first or second body arm 713 or 733.

Thus, if the reinforcement rib 76 includes the first reinforcement body 761 and the second reinforcement body 763 spaced apart from the first reinforcement body 761, the rigidity reinforcement effect of the reinforcement rib 76 is maximized and the portion requiring more rigidity reinforcement can be intensively reinforced. In addition, since the rigidity is intensively reinforced, additional material is prevented from being used for a relatively less important portion, thereby reducing the total weight of the connector C.

In case that the reinforcement rib 76 is configured to connect the first body arm 713 and the second body arm 733 together, a space formed between one connecting part 74 and another connecting part 74 can be formed narrow and small and an additional sill may be formed by the reinforcement rib 76.

Yet, as the reinforcement rib 76 is configured with the first reinforcement body 761 and the second reinforcement body 763, it is able to prevent an unnecessary sill from being formed and to prevent a space formed between one connecting part 74 and another connecting part 74 from being narrowed, thereby preventing foreign substances from being stuck in the connector C.

In some implementations, the first reinforcement body 761 and the second reinforcement body 763 may be configured as follows. First of all, if the first reinforcement body 761 moves away from the second reinforcement body 763, a length of the first reinforcement body 761 extended from the connecting point 745 toward the rotation shaft is increased. Secondly, if the second reinforcement body 763 moves away from the first reinforcement body 761, a length of the second reinforcement body 763 extended from the connecting point 745 toward the rotation shaft is increased.

So to speak, the first reinforcement body 761 may connect the connecting point 745 and the first body arm 713 in a diagonal direction, and the second reinforcement body 763 may connect the connecting point 745 and the second body arm 733 in a diagonal direction as well.

Referring to FIG. 6, lengths of the first reinforcement body 761 extended from the connecting part 745 are denoted by d1 and d2, respectively. When the extended length of the first reinforcement body located closer to the second reinforcement body 763 is referred to as d1 and the extended length of the first reinforcement body located far away from the second reinforcement body 763 is referred to as d2, d2 may be formed greater than d1.

Likewise, when the extended length of the second reinforcement body located closer to the first reinforcement body 761 is referred to as d3 and the extended length of the second reinforcement body located far away from the first reinforcement body 761 is referred to as d4, it may mean that d4 is formed greater than d3.

As describe above, it is most important to reinforce the coupling strength at the contact point between the connecting part 74 and the first/second body arm 713/733. To this end, a size of a shape of the reinforcement rib 76 may be increased when it is closer to the contact point. A size of a shape of the reinforcement rib 76 may be decreased when it is more distant from the contact point.

Hence, in case of the first reinforcement body 761, if it gets closer to the first body arm 713, it may be provided closer to the contact point between the connecting point 745 and the first body arm 713. Therefore, an extended length of the corresponding portion may be increased. If the first reinforcement body 761 gets more distant from the first body arm 713, the extended length may be decreased.

The second reinforcement body 763 may increase a length extended from the connecting point 745 if getting closer to the second body arm 733. The second reinforcement body 763 may decrease a length extended from the connecting point 745 if getting far away from the second body arm 733.

According to the above configuration, the first reinforcement body 761 may connect the connecting point 745 and the first body arm 713 together in a diagonal direction and the second reinforcement body 763 may connect the connecting point 745 and the second body arm 733 together in a diagonal direction.

Once the first reinforcement body 761 and the second reinforcement body 763 are configured above, the coupling strength between the connecting point 745 and the first/second body arm 713/733 can be intensively reinforced. Thus, a portion possible to be broken more frequently due to the concentrated stress will be reinforced more strongly and a portion relatively less probable to be broken will be reinforced less. Therefore, the weight of the connector C can be prevented from increasing due to the unnecessarily used material.

In addition, the first reinforcement body 761 and the second reinforcement body 763 may connect the connecting point 745 to the first body arm and the second body arm in a straight line or a curved surface, respectively. Regarding the first reinforcement body for example, a decreasing rate of a length extended from the connecting point 745 may decrease if the first reinforcement body gets more distant from the first body arm 713. Namely, the length of the first reinforcement body extended from the connecting point 745 may be configured in a manner of decreasing rapidly if getting far away from the first body arm 713 and then decreasing slowly. The second reinforcement body may be configured in the same shape of the first reinforcement body 761 in relation to the second body arm 733.

If the first reinforcement body 761 and the second reinforcement body 763 are configured in the above manner, sills formed by the first reinforcement body 761 and the second reinforcement body 763 can be reduced, total weight of the connector can be further reduced, and foreign substances can be further prevented from being stuck in the first reinforcement body 761 and the second reinforcement body 763 despite that water flows in during a washing course.

Figure 7:
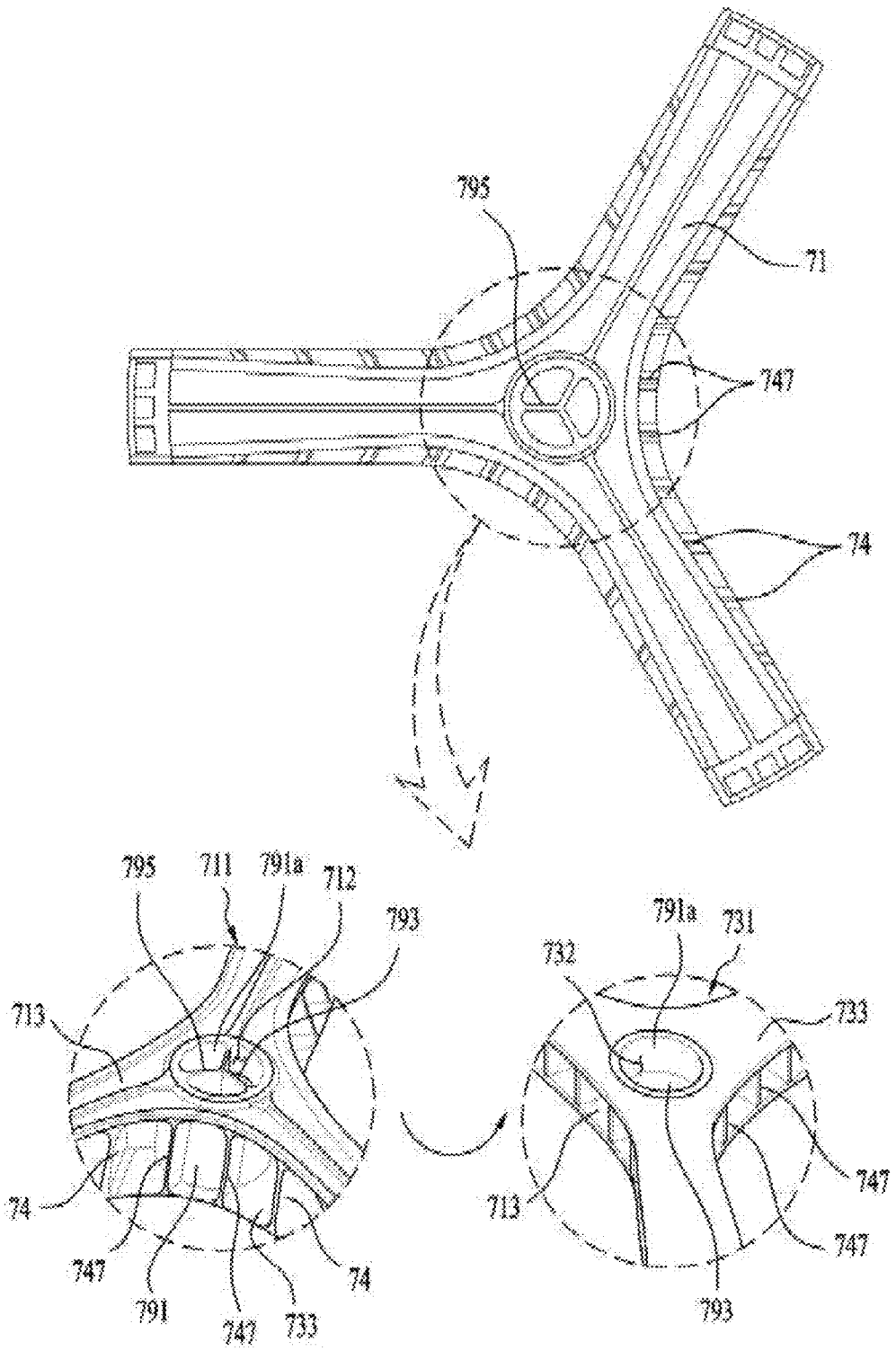
FIG. 7 is a diagram showing a connector and a rotation center of the connector according to one embodiment of the present disclosure.

FIG. 7 shows a central part of a connector provided to a laundry treating apparatus according to another embodiment of the present disclosure.

The first body hub 711 may include a first hub hole 712 perforated along a rotation center, the second body hub 731 may include a second hub hole 732 perforated along the rotation center and having the rotation shaft inserted therein, and a circumferential rib 791 connecting the first hub hole 712 and the second hub hole 732 together may be further included.

The circumferential rib 791 may connect the first and second body hubs 711 and 731 together in a manner that the first and second body hubs 711 and 731 are spaced apart from each other, and may be configured to have a hollow pipe shape by connecting the first and second hub holes 712 and 732 together.

Through the second hub hole 732 formed in the second body hub 731, the rotation shaft may be inserted and coupled thereto. The first hub hole 712 may be configured to contact with the second surface 35 located on rear side of the drum 3.

The circumferential rib 791 may assist the coupling of the first and second bodies 71 and 73 and provide a space in which the rotation shaft S is inserted. Moreover, since the circumferential rib 791 may be configured in a hollow shape while connecting a space between the first body hub 711 and the second body hub 731, it is able to reduce the total weight of the connector by the weight amounting to a volume corresponding to a space of the hollow.

In addition, further included is a support rib 795 located between the first sub hole 712 and the second hub hole 732 and extended from an inner circumferential surface 791*a* of the circumferential rib 791 toward the rotation center so as to reinforce the rigidity of the circumferential rib 791.

The support rib 795 may be configured in a shape extended from the inner circumferential surface 791*a* toward the center, which may mean that the support rib 795 is configured in a shape radially stretched from the rotation center.

The support rib 795 may be configured to traverse an inside of the circumferential rib 791 by being extended from the inner circumferential surface 791*a* of the circumferential rib toward the rotation center, by which the present disclosure is non-limited. Alternatively, the support rib 795 may be configured in a shape of being extended from various points of the inner circumferential surface 791*a* of the circumferential rib and then meeting each other at the rotation center.

As the circumferential rib 791 is configured in a hollow shape, if torque is applied to the circumferential rib 791, it may be broken or damaged possibly. Hence, the support rib 795 may perform a function of reinforcing the rigidity of the circumferential rib 791. The rigidity of the circumferential rib 791 can be sufficiently reinforced despite small increase of weight in comparison to filling up the space within the circumferential rib 791 simply.

In some implementations, included is a block rib 793 partitioning the inside of the circumferential rib by being extended from the inner circumferential surface of the circumferential rib 791 and forming a space for receiving the rotation shaft S inserted through the second hub hole 732.

The block rib 793 may be configured to support the inside of the circumferential rib 791 in a radial direction of the circumferential rib 791. The block rib 793 may prevent the first and second hub holes 712 and 732 from communicating with each other. By the block rib 793, the air having flown into the first hub hole 712 may be prevented from flowing into the second hub hole 732. Namely, the block rib 793 is provided between the first hub hole 712 and the second hub hole 732, thereby blocking a path formed by the circumferential rib 791 connecting the first and second hub holes 712 and 732.

A space for receiving the rotation shaft therein may be formed by the second hub hole 732, the circumferential rib 791 and the block rib 793. As the block rib 793 supports the inner circumferential surface 791*a* of the circumferential rib 791, the rigidity of the circumferential rib 791 can be reinforced. Thus, the overall rigidity of the connector C can be reinforced and durability of the connector C can be improved.

In some implementations, the support rib 795 may be extended from the inner circumferential surface 791*a* of the circumferential rib 791 toward the rotation center and may be also extended from the first hub hole 712 to the block rib 793 along an axial direction of the rotation shaft S. Namely, the circumferential rib 791 may partition a space located opposite to the space having the rotation shaft inserted therein.

The support rib 795 is extended from the first hub hole 712 to the block rib 793, thereby solidly supporting the hollow pipe shape formed from the first hub hole 712 to the block rib 793.

When the connector C rotates the drum 3, heavy weight may be applied to the connector C and heavier weight may be applied to the circumferential rib 791 having the rotation shaft inserted therein. Yet, as the support rib 795 can support the circumferential rib 791 by being extended from the inner circumferential surface 791*a* of the circumferential rib 791 to the rotation center, the weight applied to the circumferential rib 791 may be distributed to the support rib 795, thereby preventing breakage and improving durability.

In some implementations, the support rib 795 may be extended from the inner circumferential surface 791*a* of the circumferential rib 791 toward the rotation shaft side by side with the extended direction of the first body arm 713. Namely, when the first body arm 713 is extended from the first body hub 711, the support rib 795 may be located on an extension line of the first body arm 713.

So to speak, assuming a virtual line connecting to the center of the first hub body 711 from the free end of the first body arm 713, the support rib 795 may be located on the virtual line.

If the support rib 795 is extended from the inner circumferential surface 791*a* of the circumferential rib 791 toward the rotation center along the extended direction of the first body arm 713, the weight applied to the first body arm 713 may be distributed to the support rib 795. Hence, the overall rigidity of the connector is reinforced, thereby improving durability.

In addition, a plurality of the support ribs 795 may be included. A plurality of the support ribs 795 may be connected to each other at the rotation center in a manner of being extended from different points on the inner circumferential surface 791*a* of the circumferential rib 791 to the rotation center.

Namely, if the first body arm includes a first body first arm 713, a first body second arm 714 and a first body third arm 715, as shown in the drawing, the support ribs 795 may be extended from three points on the inner circumferential surface 791*a* of the circumferential rib 791 toward the rotation center, respectively and then connected to each other at the rotation center.

If the first body first arm 713, the first body second arm 714 and the first body third arm 715 are spaced apart from each other by the same angle, a plurality of the support ribs may be provided in a manner of being spaced apart from each other by the same angle.

Namely, the support ribs 795 are spaced apart from each other by 120 degrees, thereby distributing the weight and moment applied to the first body first arm 713, the first body second arm 714 and the first body third arm 715.

In case that a plurality of the support ribs 795 support a plurality of the first body arms 713 to 715, they can distribute the weight applied to the first body arms 713 to 715 and the circumferential rib 791 more efficiently, thereby preventing the connector C from being broken or damaged and improving durability of the connector C.

Moreover, as the durability can be improved while distributing the stress more efficiently in comparison to a case of simply increasing the number of the support ribs 795, it is able to prevent the weight of the connector C from being increased by adding the support ribs 795 unnecessarily.

In some implementations, the first body hub 711 and the second body hub 731 may be connected together via a hub connecting part 747. The hub connecting part 747 may include a board having one end fixed to the first body hub 711 and the other end fixed to the second body hub 731. The hub connecting part 747 may include a multitude of boards spaced apart from each other at the same angle centering around the rotation shaft S.

The hub connecting part 747 may be configured to connect the first body bub 711 and the second body hub 731 together by being extended from an outer circumferential surface of the circumferential rib 791. The hub connecting part 747 may be configured to be located between a plurality of the first body arms 713 to 715.

For example, in case that three first body arms 713 to 715 are provided, the hub connecting part 747 may be located between the first body first arm 713 and the first body second arm 714. In addition, the hub connecting part 747 may be located between the first body first arm 713 and the first body second arm 714 in a manner of being side by side with an extended direction of the first body third arm 715.

The hub connecting part 747 connects the space between the first body hub 711 and the second body hub 731 and may be extended from the outer circumferential surface of the circumferential rib 791, thereby supporting the circumferential rib 791. In addition, the hub connecting part 747 may couple the first body hub 711 and the second body hub 731 solidly, thereby improving the durability of the connector C.

The hub connecting part 747 may be provided between the first body first arm 713 and the first body second arm 714. The hub connecting part 747 may be provided between the first body second arm 714 and the first body third arm 715. And the hub connecting part 747 may be provided between the first body third arm 715 and the first body first arm 713. Moreover, one or more hub connecting parts 747 may be provided to each of the corresponding spaces.

If the number of the hub connecting parts 747 located between the first body first arm 713 and the first body second arm 714 increases, the first body hub 711 and the second body hub 731 can be fixed more solidly, thereby improving the durability of the connector C.

Figure 8:
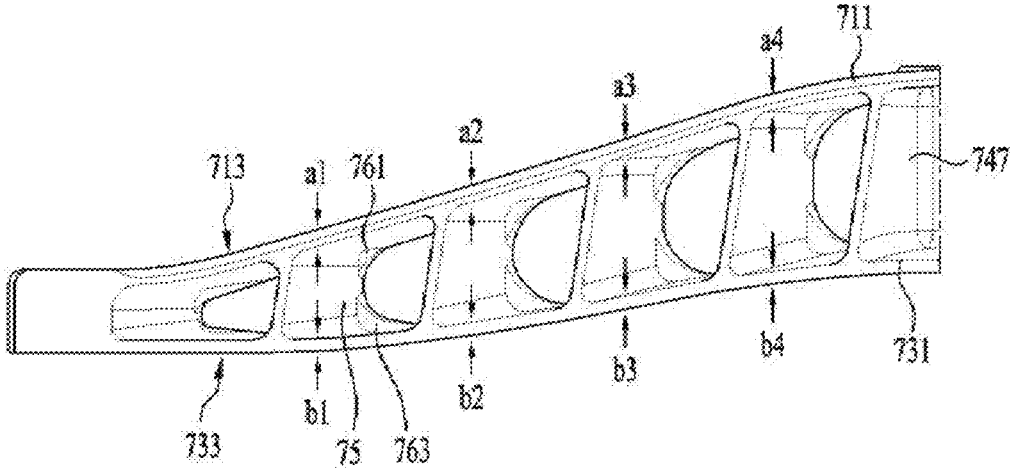
FIG. 8 is a diagram partially showing a connector according to one embodiment of the present disclosure.

FIG. 8 shows a portion of a connector of a laundry treating apparatus according to another embodiment of the present disclosure. Although the drawing relates to the first body first arm 713 and the second body second arm 734, the following description is equally applicable to the first body second arm 714 and the second body second arm 734 or to the first body third arm 715 and the second body third arm 735.

As described above, the connector C may include the first body arm 713, the second body arm 733 and the connecting part 74 connecting the first body arm 713 and the second body arm 733 together. The connecting part 74 may include a first connecting body 741 inclined from one of both confronting ends of the first body arm 713 toward the rotation shaft to connect the first body arm and the second body arm together, a second connecting body 743 inclined from the other one of the confronting ends of the first body arm 713 toward the rotation shaft to connect the first body arm and the second body arm together, and a connecting point 745 at which the first connecting body and the second connecting body are connected to each other.

The first body arm 713 may be configured to increase its thickness more at the connecting point 745 in an axial direction of the rotation shaft S if getting closer to the first body hub 711. The second body arm 733 may be configured to increase its thickness more at the connecting point 745 in an axial direction of the rotation shaft S if getting closer to the second body hub 731.

Regarding the first body arm 713, thickness of the first body arm 713 is denoted by a1, a2, a3, or a4. Thickness of the first body arm 713 at the connecting part 74 may increase more if the first body arm 713 gets closer to the first body hub 711 (i.e., a1→a4).

Thickness of the second body arm 733 is denoted by b1, b2, b3, or b4. The thickness of the second body arm 733 may be also configured to increase (e.g., b1→b4).

Since the rotation shaft is fixed to the second body hub 731, a greater force may be applied to a portion closer to the rotation shaft. Hence, to prevent the breakage of the connector C, it is more important to reinforce the rigidity of the portion to which a greater force is applied. Therefore, rigidity of a portion located closer to the first body hub 711 or the second body hub 731 is further reinforced. Since a relatively less force may be applied to a portion located distant from the first body hub 711 or the second body hub 7, weight of the connector C may be preferentially performed thereon.

Yet, since the free end of the first body arm 713 or the second body arm 733 can be coupled with the drum, it is necessary to secure sufficient rigidity. Hence, the free end of each of the first body arm 713 and the second body arm 733 may be configured to have thickness greater than that of a portion closer to the first body hub 711.

Thus, the first body arm 713 or the second body arm 733 may be configured to increase in thickness if getting closer to the first body hub 711 or the second body hub 731 with reference to the connecting point 745. Namely, the first body arm 713 may increase in thickness if located far away with reference to the connecting point 745 located farthest from the first body hub 711. And, the second body arm 733 may increase in thickness if located far away with reference to the connecting point 745 located farthest from the first body hub 711.

As described above, it is able to reduce the weight of a portion having the relatively low concentration of stress while reinforcing the rigidity of a portion at a high risk of damage due to a concentrated stress in a manner of adjusting thickness of the first body arm 713 or the second body arm 733. Power consumption can be lowered via weight reduction as well as durability of the connector C is increased.

Among the above descriptions, the description of the first body first arm 713 may be equally applied to the first body second arm 714 and the first body third arm 715, and the description of the second body first arm 733 may also be equally applied to the second body second arm 734 and the second body third arm 735. That is, the connector C may be configured to have symmetry with respect to the center of rotation.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An apparatus for treating laundry, comprising:

a tub that defines a space configured to receive water therein;

a drum that has a cylindrical shape and is configured to rotate within the tub, the drum defining a space configured to receive the laundry therein;

a motor configured to provide power to rotate the drum;

a rotation shaft coupled to the motor and configured to transmit the power from the motor; and a connector configured to transmit the power of the motor to the drum, wherein the connector comprises:

a hub having the rotation shaft fixed thereto, and a plurality of arms projected from the hub toward an edge of the drum, and wherein a thickness of at least one of the plurality of arms increases as the at least one of the plurality of arms extends from the edge of the drum to the hub, wherein the plurality of arms comprise:

a first body arm that is fixed to the drum and extends from the hub toward the edge of the drum, a second body arm to which the rotation shaft is fixed, the second body arm being spaced apart from the first body arm and extending from the hub toward the edge of the drum, and a connecting part that connects the first body arm and the second body arm to each other and maintains a state that the first body arm and the second body arm are spaced apart from each other, and wherein the hub comprises:

a first body hub located at a rotation center of the drum and fixed to the drum, the first body hub defining a first hub hole perforated along the rotation center, wherein the first body arm extends from the first body hub, a second body hub that is located within the tub and has the rotation shaft fixed thereto, the second body hub defining a second hub hole perforated along the rotation center, wherein the second body arm extends from the second body hub and faces the first body arm, and a circumferential rib that connects the first body hub and the second body hub to each other.

2. The apparatus of claim 1, wherein a thickness of the first body arm at the edge of the drum is smaller than the thickness of the first body arm at the hub.

3. The apparatus of claim 2, wherein the thickness of the first body arm gradually increases as the first body arm extends from the edge of the drum to the hub.

4. The apparatus of claim 1, wherein a thickness of the second body arm at the edge of the drum is smaller than the thickness of the second body arm at the hub.

5. The apparatus of claim 4, wherein the thickness of the second body arm gradually increases as the second body arm extends from the edge of the drum to the hub.

6. The apparatus of claim 1, further comprising:

a support rib located between the first hub hole and the second hub hole to reinforce rigidity of the circumferential rib, the support rib extending from an inner circumferential surface of the circumferential rib toward the rotation center.

7. The apparatus of claim 6, further comprising:

a block rib that extends from the inner circumferential surface of the circumferential rib and partitions an inside of the circumferential rib, the block rib defining a space for receiving the rotation shaft inserted through the second hub hole.

8. The apparatus of claim 7, wherein the support rib is extends from the first hub hole to the block rib along an axial direction of the rotation shaft.

9. The apparatus of claim 8, wherein the support rib is extends from the inner circumferential surface of the circumferential rib toward the rotation center in an extended direction of the first body arm.

10. The apparatus of claim 9, wherein the support rib is one of a plurality of support ribs that are connected to one another at the rotation center and extend from different points on the inner circumferential surface of the circumferential rib to the rotation center.

11. The apparatus of claim 10, wherein the plurality of the support ribs are spaced apart from one another by a same angle.

12. The apparatus of claim 1, wherein the connecting part comprises:

a first connecting body inclined toward the rotation shaft from one of both confronting ends of the first body arm to connect the first body arm and the second body arm together; and a second connecting body inclined toward the rotation shaft from the other one of the confronting ends of the first body arm to connect the first body arm and the second body arm together.

13. The apparatus of claim 12, wherein the connecting part is one of a plurality of connecting parts that are spaced apart from one another along a length direction of the first body arm.

14. The apparatus of claim 12, further comprising:

a reinforcement rib that extends from the connecting part in a length direction of the first body arm and connects the connecting part to the first body arm or the second body arm to thereby reinforce a coupling strength between the connecting part and the first body arm or the second body arm.

15. The apparatus of claim 14, wherein the reinforcement rib extends from one of a plurality of connecting parts and another one of the plurality of connecting parts, the plurality of connecting parts being spaced apart from each other along the length direction of the first body arm.

16. The apparatus of claim 15, wherein an extended length of the reinforcement rib extended from the one of the plurality of connecting parts is smaller than a spaced distance between the one of the plurality of connecting parts and an adjacent connecting part of the plurality of connecting parts.

17. The apparatus of claim 14, wherein the reinforcement rib comprises:

a first reinforcement body connecting the connecting part and the first body arm to each other; and a second reinforcement body connecting the connecting part and the second body arm to each other, and wherein the first reinforcement body and the second reinforcement body are spaced apart from each other along an axial direction of the rotation shaft.

* * * * *